United States Patent [19]

Goscenski, Jr.

[11] Patent Number: 4,597,746

[45] Date of Patent: Jul. 1, 1986

[54] FAN DRIVE SYSTEM FOR TRANSVERSE ENGINE

[75] Inventor: Edward J. Goscenski, Jr., Battle Creek, Mich.

[73] Assignee: Eaton Corporation, Cleveland, Ohio

[21] Appl. No.: 405,621

[22] Filed: Aug. 5, 1982

[51] Int. Cl.[3] ..... F16H 7/00

[52] U.S. Cl. ..... 474/62; 474/63; 123/41.46; 123/41.65

[58] Field of Search ..... 474/61, 62, 63, 87; 123/41.11, 41.46, 41.47, 41.65

[56] References Cited

U.S. PATENT DOCUMENTS

| | | | |
|---|---|---|---|
| 2,596,053 | 5/1952 | Stueland | 474/62 X |
| 2,691,421 | 10/1954 | Swanson | 474/62 X |
| 3,498,272 | 3/1970 | Roper | 123/41.12 |
| 3,613,645 | 10/1971 | Froumajou | 123/41.46 |
| 3,951,006 | 4/1976 | Fisher et al. | 474/87 |
| 4,040,272 | 8/1977 | Boyd | 64/26 |
| 4,187,924 | 2/1980 | Deschamps | 474/63 X |

OTHER PUBLICATIONS

Corvair, General Design, pp. 6–56.

*Primary Examiner*—James A. Leppink
*Assistant Examiner*—Frank H. McKenzie, Jr.
*Attorney, Agent, or Firm*—C. H. Grace; L. J. Kasper

[57] ABSTRACT

A system is provided for driving a cooling fan (19) of a vehicle including a transverse, water-cooled engine (E). A main drive pulley (11,13) is driven by the engine and a fan drive assembly (15) is mounted on the vehicle radiator (R) and includes a driven pulley (37). Torque is transmitted from the drive pulley to the driven pulley by means of a power transmission belt (43) including a drive portion (45) and slack portion (47). An idler pulley (55) engages the drive portion of the belt, and a tensioner device (61) and tensioner pulley (69) engage the slack portion of the belt. The tensioning device includes a rotatable arm (65) and is operable to maintain relatively constant belt tension as the engine and drive pulley move relative to the radiator and fan drive assembly.

6 Claims, 4 Drawing Figures

FAN DRIVE SYSTEM FOR TRANSVERSE ENGINE

BACKGROUND OF THE DISCLOSURE

The present invention relates to a system for driving the radiator cooling fan of a transverse, water-cooled vehicle engine, and more particularly, to such a system utilizing an endless power transmission belt.

In order to obtain the most efficient cooling of a water cooled vehicle engine, the radiator of the vehicle is normally disposed in a plane perpendicular to the vehicle axis (i.e., the direction of vehicle movement). A cooling fan is usually disposed in a plane parallel to the radiator, for the purpose of drawing air through the radiator to cool the liquid coolant circulating through the radiator. In the past, most vehicles made and sold in the United States had the engine mounted in-line (i.e., with the crankshaft parallel to the vehicle axis). In such vehicles, the radiator cooling fan was typically driven by a shaft extending from the vehicle water pump, the cooling fan either being mounted directly on the shaft, or being mounted on the output member of a viscous fluid coupling. In either case, the mounting of the cooling fan was fixed relative to the vehicle engine.

More recently, it has become common to mount the engine transversely of the vehicle, i.e., with the engine axis perpendicular to the vehicle axis. In such vehicles, the axis of the crankshaft and the axis of rotation of the cooling fan are not parallel, but instead, are disposed at right angles relative to each other. Thus, driving the radiator cooling fan by means of the engine crankshaft, either directly or indirectly, becomes more difficult, complicated, and expensive.

One of the prior art arrangements employs a pair of rigid shafts, interconnected by a set of bevel gears (see U.S. Pat. No. 3,613,654). Such an arrangement is relatively expensive, and in view of the number of other components and accessories in the engine compartment, it is extremely difficult to route a gear and shaft type drive system on most vehicle applications. In addition, having the cooling fan fixed relative to the engine requires that additional space be provided between the radiator and the fan, to accommodate movement of the engine relative to the radiator.

Another approach to driving a cooling fan from the crankshaft in a transverse engine vehicle is shown in U.S. Pat. No. 4,040,272, assigned to the assignee of the present invention. A flexible shaft is used to transmit rotational torque from the crankshaft to the fan. This arrangement requires that the flexible shaft undergo several changes of direction, or turns. In certain vehicle applications, especially in relatively smaller vehicles, the necessary routine of the flexible shaft results in several turns of relatively small radius. Operation under such conditions results in a substantially reduced torque capacity for the cable, or a substantially reduced endurance of the cable, or both.

Accordingly, it is an object of the present invention to provide an improved system for driving a radiator cooling fan of a transverse water-cooled engine.

It is another object of the present invention to provide a system which achieves the above-stated object, and which is relatively inexpensive, durable, and which comprises elements generally understood and accepted by the automative industry.

It is another object of the present invention to provide such a system which permits mounting of the cooling fan in a manner which results in optimum fan efficiency, and increased torque transmitting capacity.

The above and other objects of the present invention are accomplished by the provision of an improved system for driving a radiator cooling fan of a vehicle of the type including a vehicle frame and an engine which defines an axis of rotation and is mounted transversely of the vehicle axis. The system comprises a main drive pulley driven by the engine and rotating in a plane generally parallel to the vehicle axis. A fan drive assembly has the cooling fan operably associated therewith, the fan drive assembly defining an axis of rotation, and being fixedly mounted relative to the vehicle frame. The fan drive assembly includes a driven pulley rotating in a plane generally transverse to the vehicle axis. An endless power transmission belt is in driving engagement with the driven pulley, and in driven engagement with said main drive pulley. The belt includes a drive portion and a slack portion. Idler pulley means is provided having its axis fixedly mounted relative to either the vehicle frame or the engine, the idler pulley means being disposed forwardly of the main drive pulley, and transversely from the fan drive assembly. The idler pulley means engages the drive portion of the belt whereby said drive portion defines approximately a right angle. Also included is a belt tensioning device having a base portion fixedly mounted relative to either the vehicle frame or the engine, the tensioning device including a tensioning pulley disposed forwardly of the main drive pulley, and transversely from the fan drive assembly. The tensioning pulley engages the slack portion of the belt whereby the slack portion defines approximately a right angle.

In accordance with another aspect of the present invention, the tensioning device includes means biasing the tensioning pulley into engagement with the slack portion of the belt with a relatively constant biasing force during movement of the engine relative to the vehicle frame.

DESCRIPTION OF THE PREFERRED EMBODIMENT

Figure 1:
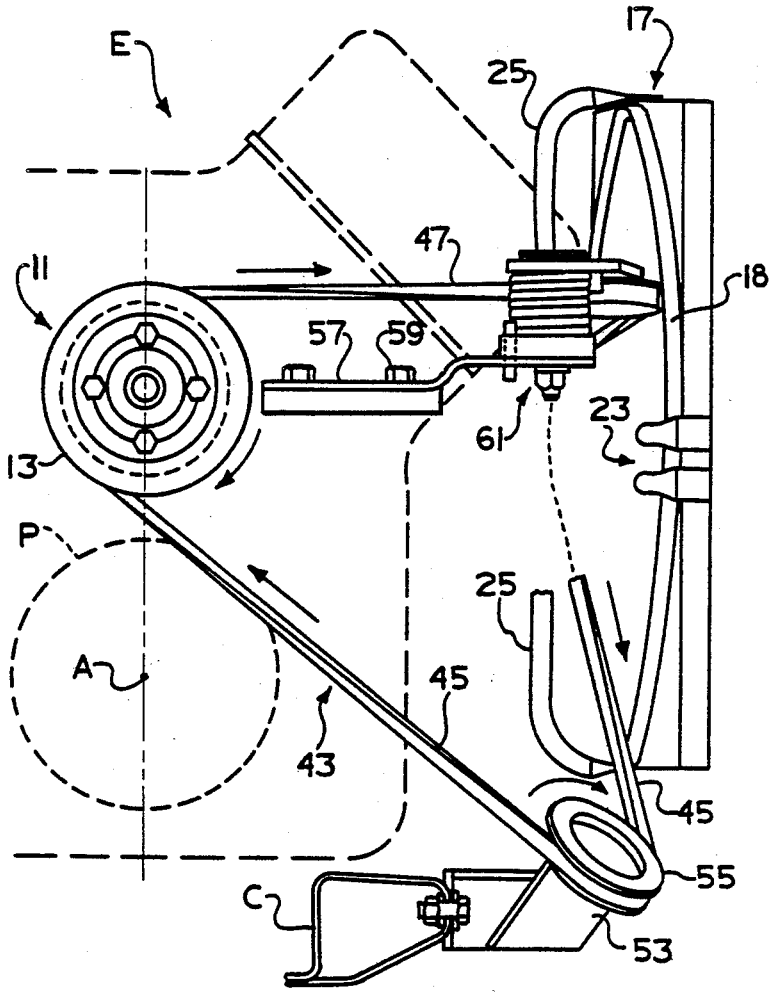
FIG. 1 is a side view of a transverse engine installation (viewed along the engine axis), incorporating the system of the present invention, and eliminating most parts of the engine installation not related to the invention.

Referring now to the drawings, which are not intended to limit the invention, FIG. 1 is a side view of a transverse engine installation showing, in dotted line, the outline of a portion of an engine, generally designated E, and shown only in FIG. 1. The engine E defines an axis of rotation A of the engine crankshaft (shown in FIGS. 1 and 3).

Figure 2:
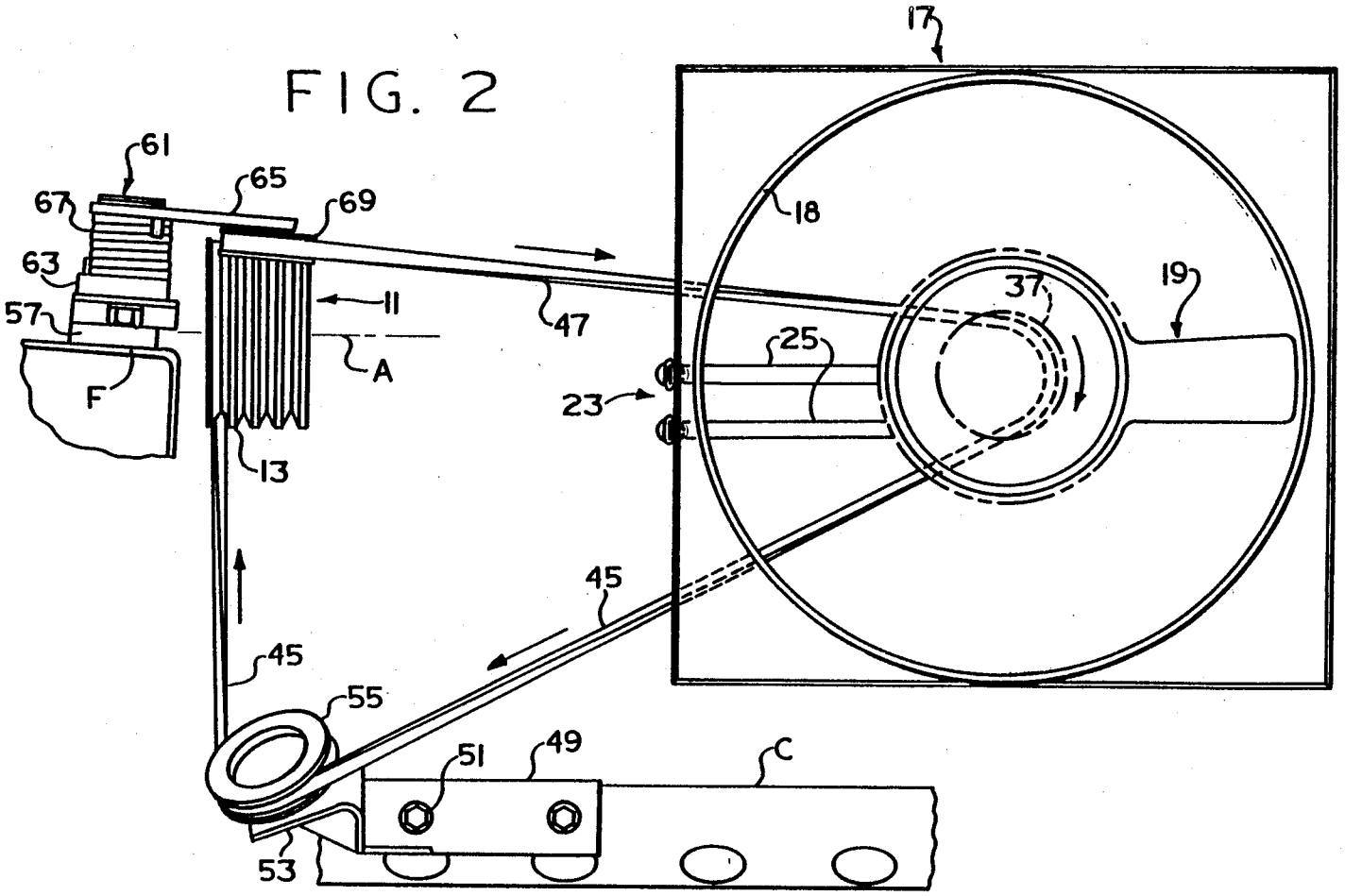
FIG. 2 is a front view of the installation (viewed along the vehicle axis), and on the same scale as FIG. 1.
Figure 3:
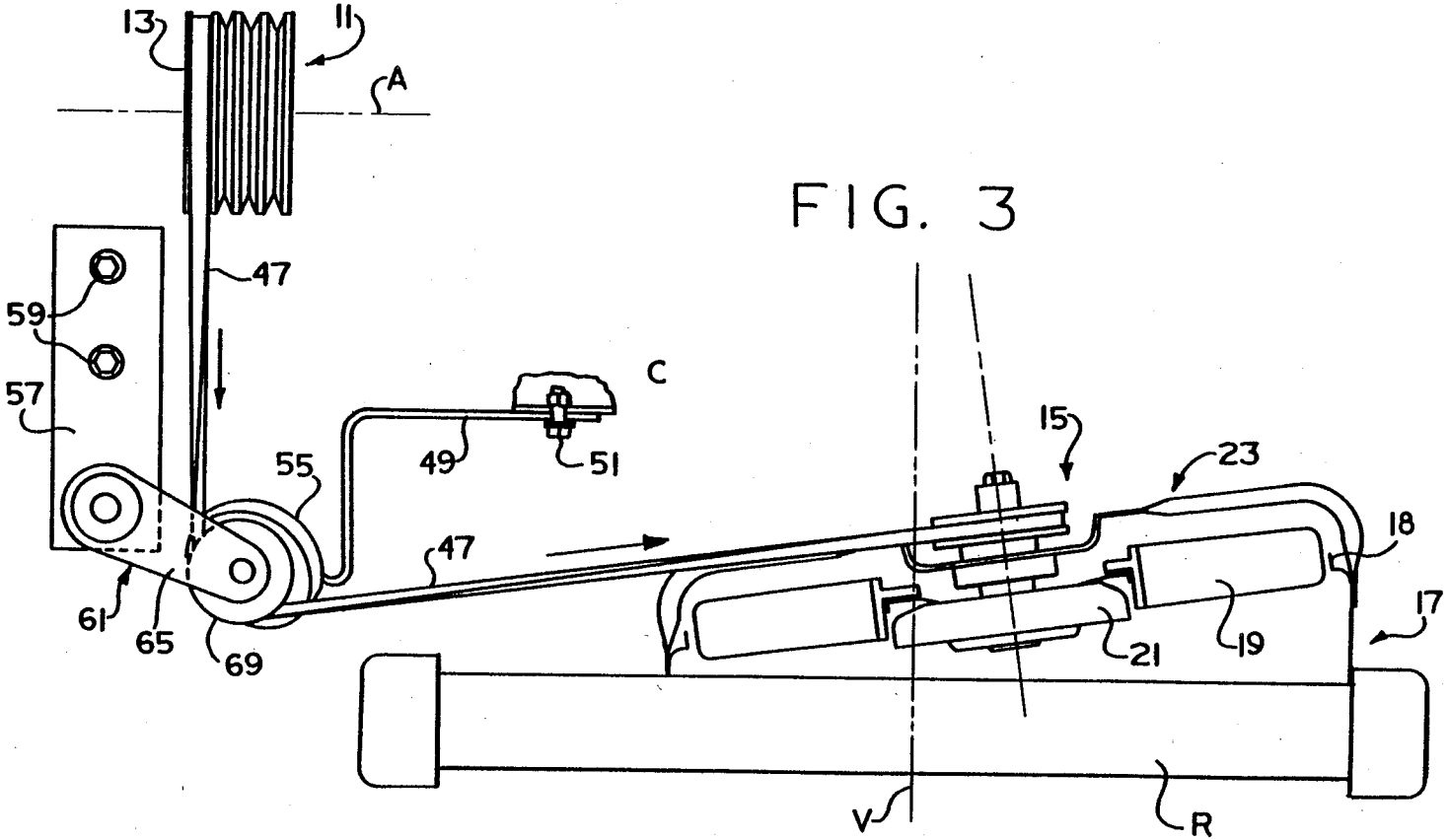
FIG. 3 is a top plan view of the installation of FIGS. 1 and 2, and on the same scale.

Disposed forwardly of the engine E is the vehicle radiator R (seen only in FIGS. 1 and 3). Also shown in the drawings, for reasons which will become apparent subsequently, is a portion of the passenger side fender F, disposed within the engine compartment (shown only in FIG. 1). Also shown, in FIGS. 1, 2, and 3, is fragmentary portion of the vehicle chassis C.

Referring now primarily to FIG. 1, it may be seen that the engine crankshaft drives a crankshaft pulley P, shown only schematically in FIG. 1. As is well known, all of the engine accessories are driven off of the pulley P by means of an arrangement of belts and pulleys, not shown in FIG. 1.

Torque is transmitted from the crankshaft pulley P to a main drive pulley 11 which, in the subject embodiment, comprises a multi-sheave pulley assembly. The main drive pulley 11 includes a pulley member 13 which comprises a direct part of the fan drive system of the present invention.

Referring now to FIG. 3, the system of the present invention includes a fan drive assembly, generally designated 15. The fan drive assembly 15, which will be described in greater detail subsequently in connection with FIG. 4, includes a fan shroud assembly, generally designated 17, which may be attached to the rear surface of the radiator R by any suitable means and includes a shroud ring 18. The fan drive assembly 15 further includes a cooling fan 19 which is attached to a fluid coupling 21. The coupling 21 is mounted to be stationary relative to the shroud assembly 17 by means of a support structure 23. Thus, the entire fan drive assembly 15 is held stationary, relative to the radiator R and the vehicle chassis C.

Figure 4:
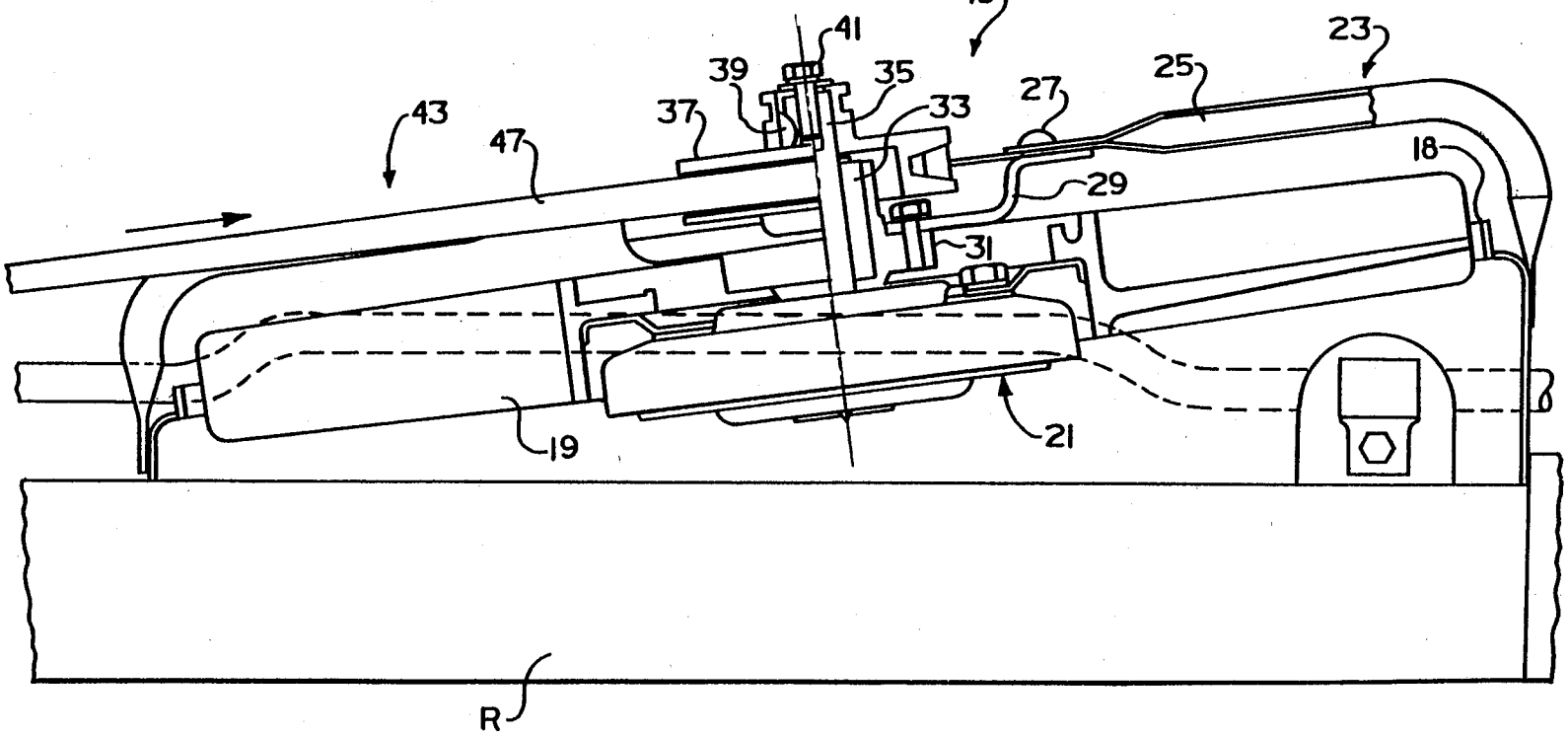
FIG. 4 is a view similar to FIG. 3, but on a scale twice that of FIG. 3, showing the fan drive assembly in greater detail.

Referring now primarily to FIG. 4, the support structure 23 includes a plurality of tubular elements 25 which have their forward ends welded to the outer surface of the shroud 17. The opposite ends of each of the elements 25 are attached as by means of a suitable fastener 27, to an annular bracket member 29 which, in turn, is bolted to an annular bearing support member 31. Disposed within the support member 31 is a set of roller bearings 33, and rotatably received therein is a shaft member 35, which comprises the input to the fluid coupling 21, in a manner well known in the art. A fan drive pulley 37 (driven pulley) is disposed on the shaft member 35, and is fixed to rotate therewith by means of a Woodruff key 39. The driven pulley 37 is retained on the shaft 35 by means of a bolt 41.

Referring again to FIGS. 1, 2, and 3, an endless power transmission belt 43 is in driving engagement with the driven pulley 37, and in driven engagement with the pulley member 13. In other words, torque is transmitted from the pulley member 13 to the fan drive pulley 37 by means of the belt 43. With the pulley member 13 rotating in the clockwise direction shown in FIG. 1, the belt 43 is driven in the direction shown by the various directional arrows shown in each of the figures. Thus, it will be understood by those skilled in the art that the belt 43 includes a drive portion 45 and a slack portion 47.

A pulley bracket 49 is attached to the vehicle chassis C by suitable means, such as a plurality of bolts 51. The bracket 49 includes a bracket portion 53, on which is mounted an idler pulley 55. It should be noted that the axis of the pulley 55 is disposed at a compound angle, i.e., it is neither parallel to, nor perpendicular to, either the axis A of the crankshaft, or an axis V of the vehicle. As is well known to those skilled in the belt and pulley art, it is important for proper operation and for endurance that a pulley rotate in a plane defined by the pitch lines of the two adjacent legs of the belt.

Although the pulley 55 is shown herein as merely an idler pulley, it should be understood that within the scope of the present invention, the pulley 55 may be associated with some other vehicle accessory which requires a rotational input. For example, the pulley 55 may be used to drive a vacuum pump if the present invention is applied to a diesel engine.

As is generally well known, during operation of the vehicle, there is a certain amount of "engine rock", i.e., movement of the engine about the crankshaft axis A caused by reaction torque. The engine rock is most noticable when the engine is accelerated quickly. In view of the occurrence of engine rock, and the fact that the pulley 13 is driven by the engine, while the fan drive assembly 15 is fixed relative to the vehicle chassis C, it is essential to the proper operation of the present invention that that the system include a suitable belt tensioning device. Referring still to FIGS. 1, 2, and 3, it may be seen that a tensioner bracket 57 is attached to the fender F by suitable means, such as a plurality of bolts 59. Bolted to the upper surface of the bracket 57 is a belt tensioning device, generally designated 61. It should be understood that the present invention is not limited to any particular configuration or mode of operation of the tensioning device 61, but instead, it is the overall function which is of more importance. In general, because the tensioning device 61 would typically engage the slack portion 47 of the belt 43, it is preferred that the device 61 be of the type which exerts a relatively low, but generally constant biasing force, and is capable of exerting the nominal biasing force over a relatively large displacement. In the subject embodiment, in order to maintain relatively constant belt tension during movement of the engine E relative to the radiator R, the tensioning device 61 may have to displace as much as 0.5 inches, or more.

In the subject embodiment, the tensioning device is constructed generally in accordance with copending U.S. application Ser. No. 289,626, for a DRIVE TENSIONING DEVICE, filed in the name of Richard W. Heater, and assigned to the assignee of the present invention. The tensioning device 61 includes a base portion 63 bolted to the bracket 57, and a rotatable arm 65 which is rotatable about an axis defined by the base portion 63. The arm 65 is biased by means of a biasing spring 67, to maintain the nominal preload, or tension on the slack portion 47 of the belt. Rotatably mounted relative to the arm 65 is a tensioner pulley 69 which engages the slack portion 47.

It should be noted that, in the subject embodiment, both the idler pulley 55 and the tensioning device 61 are shown as being fixedly mounted relative to the vehicle frame, i.e., to the chassis C and fender F, respectively. However, within the scope of the present invention, either or both of the pulley 55 and tensioning device 61 could be mounted fixed relative to the engine.

It should also be noted in FIGS. 1, 2, and 3, that the idler pulley 55 and tensioner pulley 69 are mounted, relative to the pulley member 13 and driven pulley 37 such that the drive portion 45 and slack portion 47 of the belt each define approximately a right angle. In addition, it is important to the proper operation of the belt drive system of the invention that the point of tangency of the drive portion 45 to the pulley 55 on the side toward the pulley 13 cooperate with the point of tangency of the slack portion 47 to the pulley 69, also on the side toward the pulley 13, to define a vertical line. Similarly, it is important that the point of tangency of the drive portion 45 to the pulley 55, on the side toward the driven pulley 37, cooperate with the point of tangency of the slack portion 47 to the tensioner pulley 69, also on the side toward the pulley 37, to define another vertical line. Each pair of points of tangency must define a vertical line, because each of the respective pulleys 13 and 37 are rotating in a vertical plane. Thus, the above described geometric relationship insures proper orientation of each of the adjacent legs of the belt 43, relative to the pulleys 13 and 37.

In the subject embodiment, the fan drive assembly 15 defines an axis of rotation which is not parallel to the vehicle axis V, and is not perpendicular to the radiator R, but instead, is offset therefrom by several degrees. In any particular vehicle application, the exact orientation of the fan drive assembly, and therefore, the included angle defined by each of the drive portion 45 and slack portion 47, will be determined primarily by the space available for routing the belt 43, and the space available for mounting the idler pulley 55 and tensioning device 61. Therefore, in some vehicle applications, the included angle defined by the portions 45 and 47 may be less than 90 degrees as shown herein, or may be substantially equal to 90 degrees, or may even be greater than 90 degrees.

One advantage which is a byproduct of the present invention relates to the location and efficiency of the cooling fan 19. Because the fan drive assembly 15, including the fan 19, is mounted fixed relative to the vehicle frame and radiator, rather than fixed relative to the engine, it is not necessary to accommodate movement of the fan relative to the radiator. Therefore, as may best be seen in FIGS. 3 and 4, it is possible because of the present invention to provide minimum tip clearance between the ends of the fan blades and the shroud ring 18. Reducing the tip clearance substantially increases the efficiency of operation (volume of air moved per input horsepower to the fan). It has been known for some time that reducing tip clearance increases fan efficiency, but in most prior art fan drive systems, it has not been feasible to fix the location of the fan drive assembly, relative to the radiator.

Thus, it may be seen that the present invention provides a system for driving the cooling fan of a transverse, water-cooled engine which, because of the use of a belt, is simple and relatively inexpensive, but at the same time, results in optimum fan efficiency and a greater torque transmitting capacity than many prior art systems. In addition, the system of the present invention may be utilized in many vehicle applications where the engine compartment is quite small and crowded with numerous vehicle accessories and components, and wherein the use of known prior art fan drive systems would be difficult, or impossible.

The present invention has been described in detail sufficient to enable one skilled in the art to practice the invention. It is believed that upon a reading and understanding of the specification, certain obvious modifications and alterations of the invention will become apparent to those skilled in the art, and it is intended to include all such alterations and modifications as part of the present invention, insofar as they come within the scope of the appended claims.

I claim:

1. A system for driving a radiator cooling fan of a vehicle of the type including a vehicle frame and an engine defining an axis of rotation, mounted transversely of the vehicle axis, said engine being capable of substantial movement about said axis of rotation, said system comprising:

(a) a main drive pulley driven by the vehicle engine and rotating in a plane generally parallel to the vehicle axis;

(b) a fan drive assembly having the cooling fan operably associated therewith, said fan drive assembly defining an axis of rotation and being fixedly mounted relative to the vehicle frame and including a driven pulley rotating in a plane generally transverse to the vehicle axis;

(c) an endless power transmission belt in driving engagement with said driven pulley and in driven engagement with said main drive pulley, said belt including a drive portion and a slack portion;

(d) idler pulley means having its axis fixedly mounted relative to one of the vehicle frame and the engine, said idler pulley means being disposed forwardly of said main drive pulley and transversely from said fan drive assembly, said idler pulley means engaging said drive portion of said belt whereby said drive portion defines approximately a right angle; and (e) a belt tensioning device including a base portion fixedly mounted relative to one of the vehicle frame and the engine, said tensioning device including a tensioning pulley disposed forwardly of said main drive pulley and transversely from said fan drive assembly, said tensioning pulley engaging said slack portion of said belt whereby said slack portion defines approximately a right angle.

2. In a system for driving a radiator cooling fan of a vehicle of the type including a vehicle frame and an engine defining, an axis of rotation and mounted transversely of the vehicle axis, the system being of the type including a main drive pulley driven by the vehicle engine and rotating in a plane generally parallel to the vehicle axis, a fan drive assembly having the cooling fan operably associated therewith and a driven pulley rotating in a plane generally transverse to the vehicle axis, an endless power transmission belt in driving engagement with said driven pulley, and in driven engagement with said main drive pulley, said belt including a drive portion and a slack portion, first and second pulley means, each of said pulley means having its axis fixedly mounted relative to one of the vehicle frame and the engine, each of said pulley means being disposed forwardly of said main drive pulley and transversely from said fan drive assembly, said first pulley means engaging said drive portion of said belt whereby said drive portion defines approximately a right angle, and said second pulley means engaging said slack portion of said belt whereby said slack portion defines approximately a right angle, characterized by said fan drive assembly defining an axis of rotation fixedly mounted relative to the vehicle frame.

3. The system as claimed in claim 2 characterized by said second pulley means comprising a belt tensioning device including a base portion which is fixedly mounted, and a tensioning pulley which is movable relative to said base portion.

4. The system as claimed in claim 1 or 3 characterized by said belt tensioning device includes means biasing said tensioning pulley into engagement with said slack portion of said belt with a relatively constant biasing force during movement of the vehicle engine, relative to the vehicle frame.

5. The system as claimed in claim 2 characterized by said fan drive assembly including a fluid coupling device having an input and an output, its input being operably associated with said driven pulley, and the cooling fan being attached to the output of said fluid coupling device.

6. The system as claimed in claim 3 characterized by said base portion of said belt tensioning device being fixedly mounted relative to the vehicle frame and by said first pulley means being fixedly mounted relative to the vehicle frame.

* * * * *

UNITED STATES PATENT AND TRADEMARK OFFICE

CERTIFICATE OF CORRECTION

PATENT NO. : 4,597,746

DATED : Jul. 1, 1986

INVENTOR(S) : Edward J. Goscenski, Jr.

It is certified that error appears in the above-identified patent and that said Letters Patent are hereby corrected as shown below: The Claims should read as follows:

CLAIMS:

1. A system for driving a radiator cooling fan of a vehicle of the type including a vehicle frame and an engine defining an axis of rotation, mounted transversely of the vehicle axis, said engine being capable of substantial movement about said axis of rotation, said system including a main drive pulley driven by the vehicle engine and rotating in a plane generally parallel to the vehicle axis; a fan drive assembly having the cooling fan operably associated therewith, said fan drive assembly defining an axis of rotation and including a driven pulley rotating in a plane generally transverse to the vehicle axis; an endless power transmission belt in driving engagement with said driven pulley and in driven engagement with said main drive pulley, said belt including a drive portion and a slack portion; idler pulley means being disposed forwardly of said main drive pulley and transversely from said fan drive assembly, said idler pulley means engaging said drive portion of said belt whereby said drive portion defines approximately a right angle; and a belt tensioning device including a base portion, said tensioning device including a tensioning pulley disposed forwardly of said main drive pulley and transversely from said fan drive assembly, said tensioning pulley engaging said slack portion of said belt whereby said slack portion defines approximately a right angle, characterized by:

UNITED STATES PATENT AND TRADEMARK OFFICE

CERTIFICATE OF CORRECTION

PATENT NO. : 4,597,746

DATED : Jul. 1, 1986

INVENTOR(S) : Edward J. Goscenski, Jr.

It is certified that error appears in the above-identified patent and that said Letters Patent are hereby corrected as shown below:

(a) said idler pulley means having its axis fixedly mounted relative to one of the vehicle frame and the engine;

(b) said base portion of said belt tensioning device being fixedly mounted relative to one of the vehicle frame and the engine; and (c) said fan drive assembly axis of rotation being fixedly mounted relative to the vehicle frame and the radiator to optimize fan efficiency despite movement of the engine relative to the radiator.

2. The system as claimed in claim 1 characterized by said belt tensioning device includes means biasing said tensioning pulley into engagement with said slack portion of said belt with a relatively constant biasing force during movement of the vehicle engine, relative to the vehicle frame.

3. The system as claimed in claim 1 characterized by said fan drive assembly including a fluid coupling device having an input and an output, its input being operably associated with said drive pulley, and the cooling fan being attached to the output of said fluid coupling device.

UNITED STATES PATENT AND TRADEMARK OFFICE

CERTIFICATE OF CORRECTION

PATENT NO. : 4,597,746

DATED : Jul. 1, 1986

INVENTOR(S) : Edward J. Goscenski, Jr.

It is certified that error appears in the above-identified patent and that said Letters Patent are hereby corrected as shown below:

4. The system as claimed in claim 1 characterized by at least one of said base portion of said belt tensioning device and said idler pulley means being fixedly mounted relative to the vehicle frame and radiator.

5. The system as claimed in claim 1 characterized by said base portion of said belt tensioning device being fixedly mounted relative to the vehicle frame and radiator.

6. The system as claimed in claim 1 characterized by said idler pulley means being fixedly mounted relative to the vehicle frame and radiator.

Signed and Sealed this

Twenty-first Day of April, 1987

*Attest:*

DONALD J. QUIGG

*Attesting Officer*

*Commissioner of Patents and Trademarks*